US006659414B1

(12) United States Patent
Guilmette

(10) Patent No.: US 6,659,414 B1
(45) Date of Patent: Dec. 9, 2003

(54) SHEET HANGER

(76) Inventor: Paul L. Guilmette, P.O. Box 13, Canton Center, CT (US) 06020

( * ) Notice: Subject to any disclaimer, the term of this patent is extended or adjusted under 35 U.S.C. 154(b) by 0 days.

(21) Appl. No.: 09/663,178

(22) Filed: Sep. 15, 2000

(51) Int. Cl.[7] ..... A47H 1/16
(52) U.S. Cl. ..... 248/303; 248/339
(58) Field of Search ..... 248/302, 303, 248/304, 215, 217.3, 218.2, 218.3, 218.1, 216.1, 339

(56) References Cited

U.S. PATENT DOCUMENTS

| | | | | | |
|---|---|---|---|---|---|
| 2,470,878 | A | * | 5/1949 | Tate | 248/303 X |
| 2,912,204 | A | * | 11/1959 | Raysinger | 248/215 |
| 3,219,302 | A | * | 11/1965 | Smith | 248/218.3 |
| 3,240,463 | A | * | 3/1966 | Cook | 248/339 |
| 5,207,403 | A | | 5/1993 | Penniman | 248/215 |
| 5,285,364 | A | * | 2/1994 | Bayer | 248/303 X |
| 5,413,297 | A | * | 5/1995 | Adams | 248/215 |
| 5,487,517 | A | * | 1/1996 | Smith | 248/215 |
| 6,250,595 | B1 | * | 6/2001 | Campbell | 248/339 X |
| 6,254,050 | B1 | * | 7/2001 | Albrecht et al. | 248/303 |
| 6,257,421 | B1 | * | 7/2001 | Outten | 211/40 |

OTHER PUBLICATIONS

Heath® Zenith Motion Sensor Light Control Operation Manual, Model SL–5412, pp. 1–4, © Heath Company 1977.

* cited by examiner

*Primary Examiner*—Ramon O. Ramirez

(57) ABSTRACT

A hanger (100) comprising a suspension hook (102), a shank (104) and a retainer (106) is fashioned from a single piece of heavy gauge wire curved into a predetermined shape. Suspension hook (102) has a tip (114) capable of easily penetrating heave gauge sheeting material such as 6 mil polyethylene or canvas. Retainer (106) is configured to engage a ceiling tile support rail either between a support rail and a ceiling tile or between a support rail and a wall. In other embodiments, the hanger (100) may be configured to engage a masonry nail or other fastener or may be configured to be driven directly into the wall. The hanger may be bent in a single plane or bent in two or more planes.

15 Claims, 5 Drawing Sheets

SHEET HANGER

BACKGROUND OF THE INVENTION

1. Field of the Invention

This invention relates to the field of hangers suitable for suspending signs, temporary wiring, sheets or tarpaulins, such as heavy gauge polyethylene sheets used in asbestos removal operations.

2. Related Art

Various circumstances require the hanging of objects from numerous, closely set, and desirably strong hangers. One example is the temporary hanging of decorative Christmas or other holiday lights; the supports must be placed close together and be strong enough to support the wiring. Another example would be the hanging of banners and signs, which are desirably supported across their top edge in order to reduce or avoid sagging in the middle. Yet another example is from the field of asbestos removal wherein plastic sheeting must be held in place to provide a barrier against dispersal of asbestos fibers. The process of removing carcinogenic asbestos from structures requires that the area in which the work is being done be isolated from the environment. This isolation is accomplished by sealing the area with multiple layers of heavy gauge polyethylene sheets. These sheets may be quite heavy, e.g., 6 mils in thickness. The sheets must be hung around the entire perimeter of the room or area to be isolated, laid to cover the floor, and then sealed closed, for example, with duct tape, to prevent asbestos fibers from leaking out from between the seams. The area is then maintained at a slight negative atmospheric pressure in order to ensure that any leaks in the enclosure are of clean outside air into the room, and not of asbestos fibers from the room. As is well known in the art, the slight negative pressure is maintained using an air filtration unit to suck air from the room, filter or scrub it, and then release it into the environment. The system works most efficiently when the leaks in the isolation system are kept to zero. Thus, there should be no holes in the plastic. Similar circumstances prevail whenever a vapor or particulate barrier must be erected.

Hanging large sheets is a difficult process. In known methods of hanging, the sheets are hung either using strips of furring nailed to the wall, or are adhered directly to the wall with tape or adhesive, or are hung from hooks. All of these methods present problems, chiefly in the form of damage to the wall. Other problems include the expenditure of time and labor in the hanging process, and the difficulty of maintaining a tight seal.

One reference to these problems can be found in U.S. Pat. No. 5,207,403, issued May 4, 1993 to D. T. Penniman and entitled "Device and Method to Support Polyethylene or Other Sheeting". Penniman teaches the use of a flat, triangular-pointed prong stamped out of a thin sheet metal bracket-like device. The device has a clip, as illustrated in FIG. 2 of the '403 Patent. The clip enables the device to be suspended from ceiling tile support rails. When Penniman's device is adhered to a wall, however, nails, screws, glue or tape are needed and these methods of support cause damage to the wall, and also require significant labor and materials. While the device of the '403 Patent is designed to allow users to impale the plastic onto the hook and let it dangle therefrom, the heavy gauge plastic required in asbestos removal operations causes the thin prong to bend or pull out of the wall. The weakness of the thin sheet metal also makes the hook prone to bend if tension is transmitted to it by the suspended plastic, for example, by a user accidentally stepping onto or otherwise tugging a projecting fold of the plastic. The clip portion engages only the exposed horizontal bottom of the ceiling tile support rail, and is thus easily pulled free by accidental tugs on sheets suspended from it.

In order to avoid damage to the prong and avoid pulling the device from the support rail or wall, it is necessary to add a separate step of pre-slitting the plastic with a knife in order to create a hole for the prong to pass through and thereby reduce mechanical stress on the prong. The slit made by the knife must necessarily be wide enough to span the width of the wide hook stamped out of the thin sheet metal. This slit allows ingress of air when the blower is working or, should the blower malfunction or be turned off, allows the egress of asbestos fibers from the room.

It would be advantageous to have easily manufactured hangers, capable of supporting objects such as, for example, plastic sheeting, tarpaulins, signs, banners, or temporary wiring or lighting, made of a material which allows easy penetration of plastic sheeting and which are strong enough to support such objects and resist mechanical deformation. It would also be advantageous for such hangers to cause minimal damage to the walls of a structure on which, e.g., plastic sheeting is suspended, and to make holes in the plastic sheets which are substantially entirely filled and closed by the hanger's penetration of the plastic sheeting.

SUMMARY OF THE INVENTION

In accordance with the present invention there is provided a wire hanger for supporting material therefrom. The wire hanger comprises a length of wire configured to define a shank having a suspension hook formed at one end thereof and a retainer formed at the opposite end thereof, the retainer being dimensioned and configured to be mounted to a support structure.

In one aspect of the invention, the suspension hook has a sharpened tip, for example, the tip may have a wedge-like surface.

Another aspect of the present invention provides that the retainer is dimensioned and configured to engage a support structure selected from the group consisting of a ceiling tile support rail, a pipe, a door top, and a wall, for example, the retainer may be dimensioned and configured to engage such support structure having a T- or L-shaped cross section.

In a particular aspect of the present invention, the retainer is dimensioned and configured to engage such support structure having a T-shaped cross section, comprised of a vertical leg and a horizontal leg. In this aspect, the wire hanger comprises an off-set extension extending from the shank, a longitudinal extension extending from the off-set extension, and a retainer hook formed at the end of the longitudinal extension, the retainer hook being dimensioned and configured to fit over such vertical leg.

Other aspects of the present invention provide the following features, alone or in combinations of two or more thereof: the wire hanger may have an eye through which an attaching member, e.g., a nail or screw, may be placed to secure the wire hanger to a wall; the retainer may comprise a straight piece of wire dimensioned and configured to be driven into such support structure, the straight piece of wire extending from the shank at an angle of about 70 to 110°; the retainer may lie in a first plane and the hook may lie in a second plane different from the first plane; the angle between the first plane and the second plane may be from about 30 to 60 degrees; the retainer may have a retainer hook formed thereon and the retainer hook and the suspension hook may extend in opposite directions from the shank; the retainer hook and the suspension hook may have different radii; the retainer may have a retainer hook formed thereon and the retainer hook and the suspension hook may extend in the same direction from the shank; the retainer hook and the suspension hook may have different radii; and wire may comprise an annealed spring wire.

DETAILED DESCRIPTION OF THE INVENTION AND PREFERRED EMBODIMENTS THEREOF

Figure 1A:
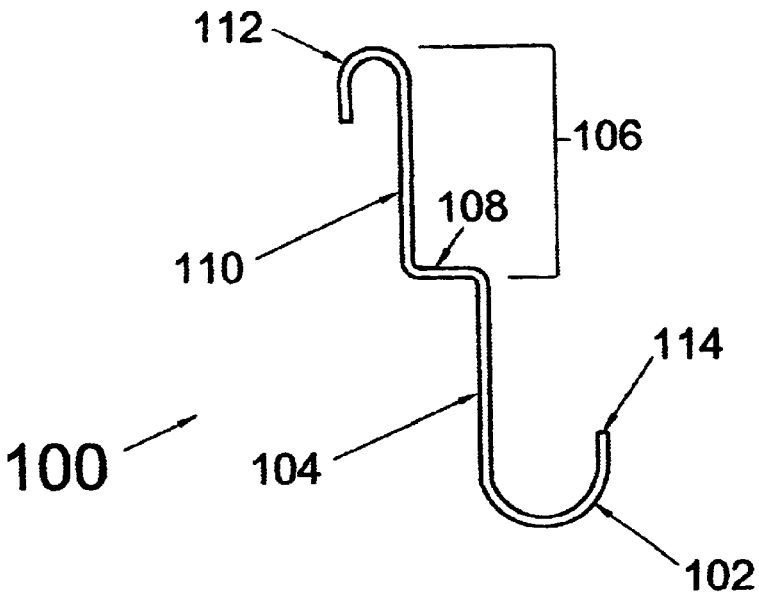
FIG. 1A is a side view of a hanger according to one embodiment of the invention.
Figure 1B:
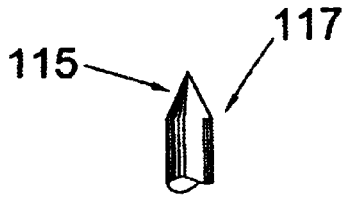
FIG. 1B is a side view of a tip of a hook of the hanger of FIG. 1A.

FIG. 1A is a side view of a hanger 100 according to one embodiment of the invention. Hanger 100 comprises suspension hook 102 having a tip 114, a shank 104 and a retainer 106. Retainer 106 comprises an off-set extension 108, a longitudinal extension 110, and a retainer hook 112. Hanger 100 is constructed of a single piece of heavy gauge wire, e.g. 0.062 inch diameter wire, bent to the illustrated shape. Wire of other gauges may be used as well, provided that the wire has sufficient strength to allow penetration and support of the sheet material to be hung. Tip 114 is not sharpened in this Figure, but in FIG. 1B a tip 117 shows a wedge-like surface 115. A sharpened tip may be used, for example, when the material to be punctured is canvas, or other very strong fabric. Retainer 106 is dimensioned and configured to fit a standard ceiling tile support rail, and to take advantage of the ceiling tile itself, if still in place in the ceiling tile support rail, as a source of additional stability, as described below.

Figure 2:
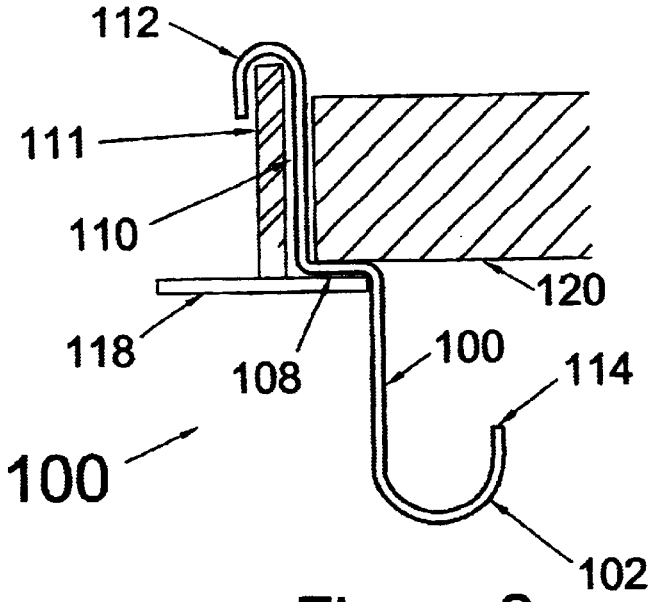
FIG. 2 is a cross-sectional view of the hanger of FIG. 1 in use in a ceiling.

The embodiment illustrated in FIG. 1A is designed to fit over a ceiling tile support rail having an inverted T-shaped cross section. FIG. 2 illustrates hanger 100 in use on a conventional ceiling tile support rail 118 which supports a conventional ceiling tile 120, parts of which are broken away in FIG. 2. To install hanger 100, the user lifts ceiling tile 120 slightly out of ceiling tile support rail 118 and places retainer hook 112 over a vertical leg 111 of support rail 118. After ceiling tile 120 is dropped back into place, retainer 106 is disposed between support rail 118 and ceiling tile 120. When ceiling tile 120 is present, off-set extension 108 and longitudinal extension 110 cooperate to allow penetration of the retainer 106 between support rail 118 and the edge of ceiling tile 120, allowing ceiling tile 120 to rest in its normal position atop support rail 118. Friction between the bottom of ceiling tile 120 and off-set extension 108 and longitudinal extension 110 lends further stability to hanger 100. With retainer 106 hung over ceiling tile support rail 118, sheets (not shown) may be impaled upon tip 114 of suspension hook 102 and allowed to hang suspended therefrom. The sheets may be plastic sheets for asbestos removal or cloth for banners, advertisements, and signs, or other similar materials. The hangers may also be used for temporary wiring and similar uses. While the illustration shows the advantageous stability added by ceiling tile 120 to hanger 100, hanger 100 can be used even when ceiling tile 120 is not present because of the conformance of retainer 106 to the inverted T-shaped cross section of support rail 118.

The invention overcomes prior art problems by providing suspension hook 102 having sufficient strength to penetrate thick plastic or cloth sheets without pre-slitting of the sheets. Retainer 106 of hanger 100 also engages a substantial part of support rail 118 and remains firmly in place under pressure, unlike known hangers that are merely clipped to the bottom portion of a support rail. The hole made in the sheet by the heavy gauge wire of tip 114 is also quite small in comparison to the wide slits necessary for use with some known hangers, and is substantially sealed by hanger 100. Finally, since hanger 100 is constructed of heavy wire, not thin sheet metal, suspension hook 102 is not prone to bend under strain, does not suffer significant metal fatigue, and may be reused indefinitely, without breaking after a modest number of uses.

Figure 3:
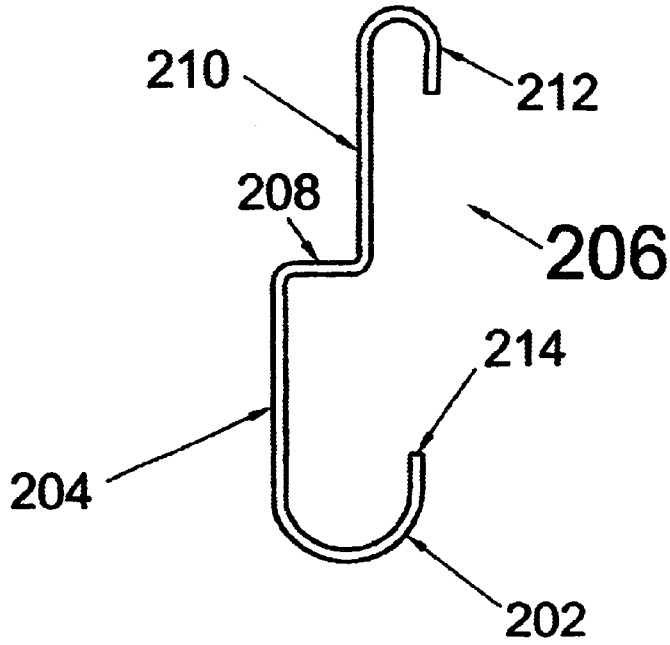
FIG. 3 is a side view of a hanger according to a second embodiment of the invention.

FIG. 3 illustrates a second embodiment of the invention. Hanger 200 has a suspension hook 202 having a tip 214, a shank 204 and a retainer 206. Retainer 206 has an off-set extension 208, a longitudinal extension 210 and retainer hook 212. As in the previous embodiment, suspension hook 202 and retainer 206 lie in the same plane. However, unlike the previous embodiment, retainer 206 and suspension hook 202 are oriented in the same direction relative to shank 204. The utility of this is as follows. Normally, groups of hangers are hung in straight lines along a support rail, with the hooks all facing in one direction and sheets of material hanging therefrom. The embodiment illustrated in FIG. 3 is useful when, for example, one ceiling tile in the line cannot be lifted. Ceiling tiles may become wedged in place and difficult to move, or may not be movable due to the presence of a light fixture or other installation. In that event, hanger 200 can be hung from the adjacent tile with the hook substantially in the proper position and orientation, maintaining the line of hooks without interruption. Hanger 200 is obviously also useful in a wide range of situations, such as those mentioned previously.

Figure 4:
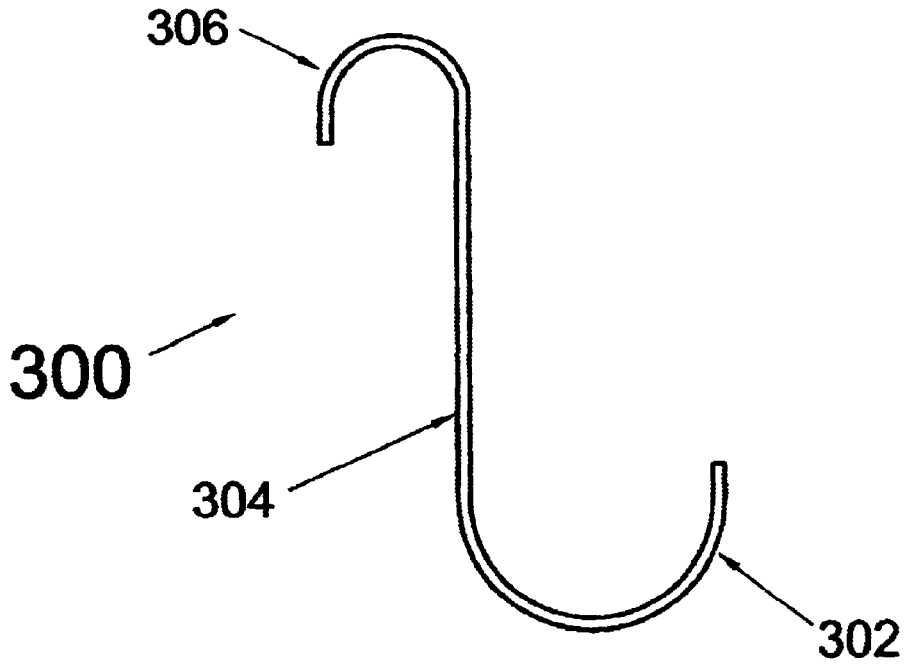
FIG. 4 is a side view of a hanger according to a third embodiment of the invention.

FIG. 4 is a side view of hanger 300, according to a third embodiment of the invention. Hanger 300 comprises a suspension hook 302, a shank 304, and a retainer 306. The shape of hanger 300 is suitable for engagement with a pipe, bar, rod, the top of a door or wall, or other similar support member. In the embodiment illustrated, suspension hook 302 is of greater radius than retainer 306; however, both may be the same size or retainer 306 may be larger. Note that hanger 300 can also be used upside-down, thus allowing hanger 300 to function well when used with supports having a range of diameters.

In a fourth embodiment, illustrated in FIG. 4, suspension hook 302 and retainer 306 are both arcuate semi-circles, but in other embodiments, both components may be other curves, angular, sections of straight wire, or other shapes. Thus hanger 300 may be dimensioned and configured to suit a wide variety of supports.

Figure 5:
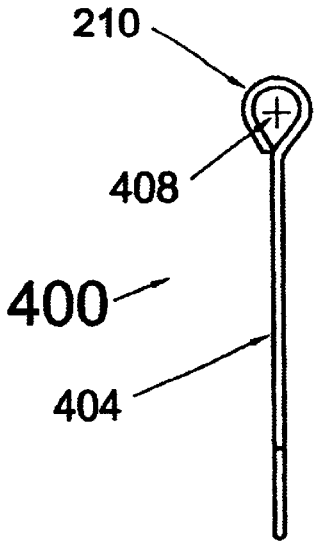
FIG. 5 is a frontal view of a hanger according to a fourth embodiment of the invention.
Figure 6:
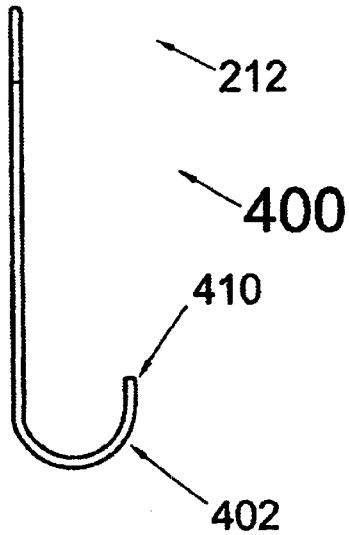
FIG. 6 is a side view of the hanger illustrated in FIG. 5.

FIG. 5 is a frontal view of hanger 400 according to a fifth embodiment of the invention. Hanger 400 comprises a suspension hook 402 (FIG. 6), a shank 404, and a retainer 406 defining an eye 408. Suspension hook 402 has a tip 410. Eye 408 is dimensioned and configured to receive therethrough a nail, screw, bolt, rod, tack, pin, or other similar fastener. In the embodiment illustrated, eye 408 is dimensioned to receive a masonry nail (not shown) as the support, allowing hanger 400 to be fastened to a concrete or masonry wall. In use, the masonry nail is driven into the wall through eye 408, and then sheets are impaled upon tip 410 and allowed to hang from suspension hook 402. Hanger 400 may also be utilized to support wiring.

Figure 7:
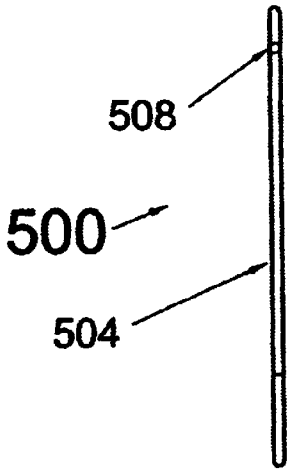
FIG. 7 is a frontal view of a hanger according to a fifth embodiment of the invention.
Figure 8:
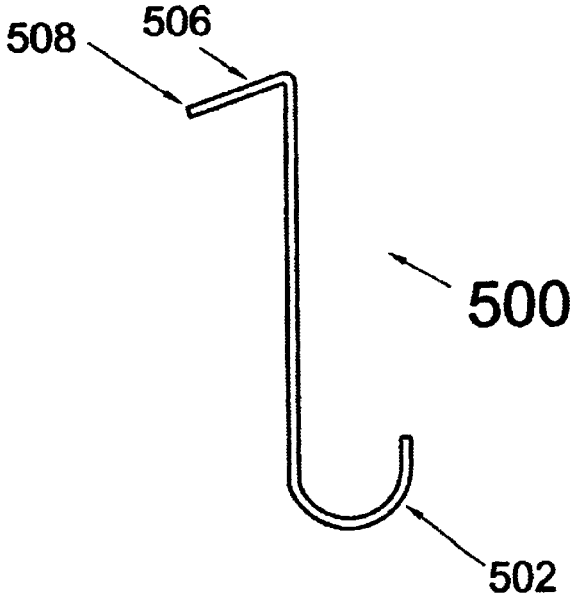
FIG. 8 is a side view of the hanger illustrated in FIG. 7.

FIG. 7 is a frontal view of hanger 500 according to a sixth embodiment of the invention, while FIG. 8 is a side view of hanger 500. Hanger 500 has a suspension hook 502, a shank 504, a retainer 506, and a retainer tip 508.

Retainer 500 is suitable for being driven into sheet rock, particle board, plywood, and other similar, relatively soft, wall materials. Retainer tip 508 is not sharpened in the present embodiment, but may be sharpened in other embodiments. The dimensions and exact configuration of retainer tip 508 may also be varied to suit the type of wall, thickness of the wall board, hardness of the wall material and so on. In the embodiment shown, retainer 506 is inclined at an angle of about 5 degrees below the horizontal as sensed in FIG. 8, but it may be positioned at other angles, e.g., from about 0 to 20 degrees below the horizontal, in other embodiments of the invention.

In use, retainer tip 508 is driven into a wall (not shown) with a hammer, by hand, by pre-drilling a hole, with pliers or by means of other tools. Sheets are then impaled upon suspension hook 502. Hanger 500 is susceptible to a variety of methods of use: it may be wedged in between the top of a door and the bottom of the door frame, suspended from a ceiling tile support rail or used in many other ways.

Figure 9:
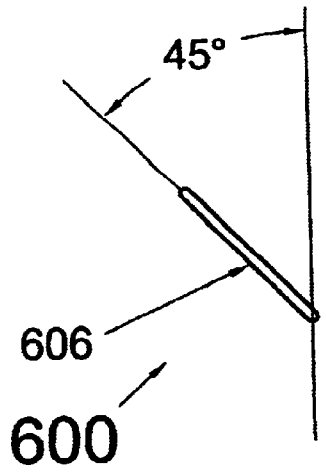
FIG. 9 is an end view of the retainer of a hanger according to a sixth embodiment of the invention.
Figure 10:
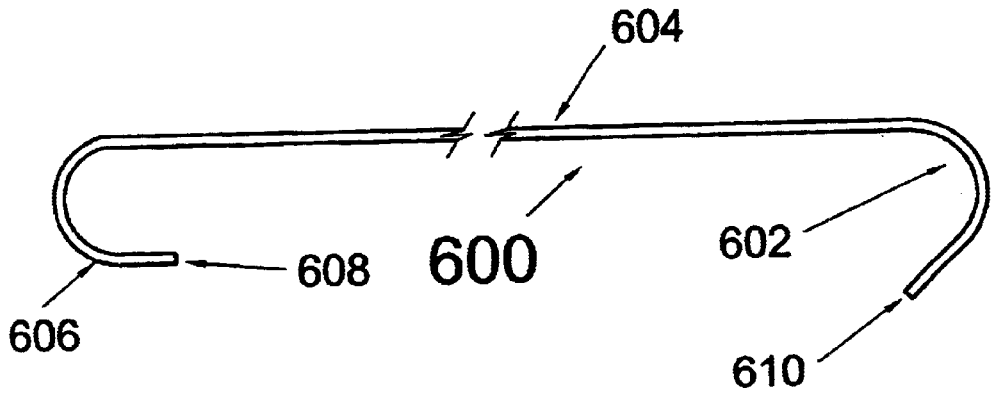
FIG. 10 is a side view of the hanger illustrated in FIG. 9.
Figure 11:
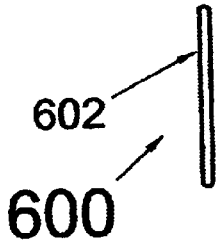
FIG. 11 is an end view of the hook of the hanger illustrated in FIG. 9.

FIG. 9 is an end view of a retainer 606 of a hanger 600 according to a seventh embodiment of the invention, while FIG. 10 is a side view of hanger 600 and FIG. 11 is an end view of a suspension hook 602 of the same embodiment. Hanger 600 comprises suspension hook 602, a shank 604, and retainer 606. Retainer 606 in turn comprises a retainer tip 608, while hook 606 comprises a hook tip 610.

In contrast to previously illustrated embodiments of the invention, hanger 600 is bent into a shape in which suspension hook 602 and retainer 606 are not coplanar, as illustrated in FIG. 9. The plane of retainer 606 is inclined to the plane of suspension hook 602 by an angle of substantially 45 degrees, but may range from 30 to 60 degrees.

Figure 12:
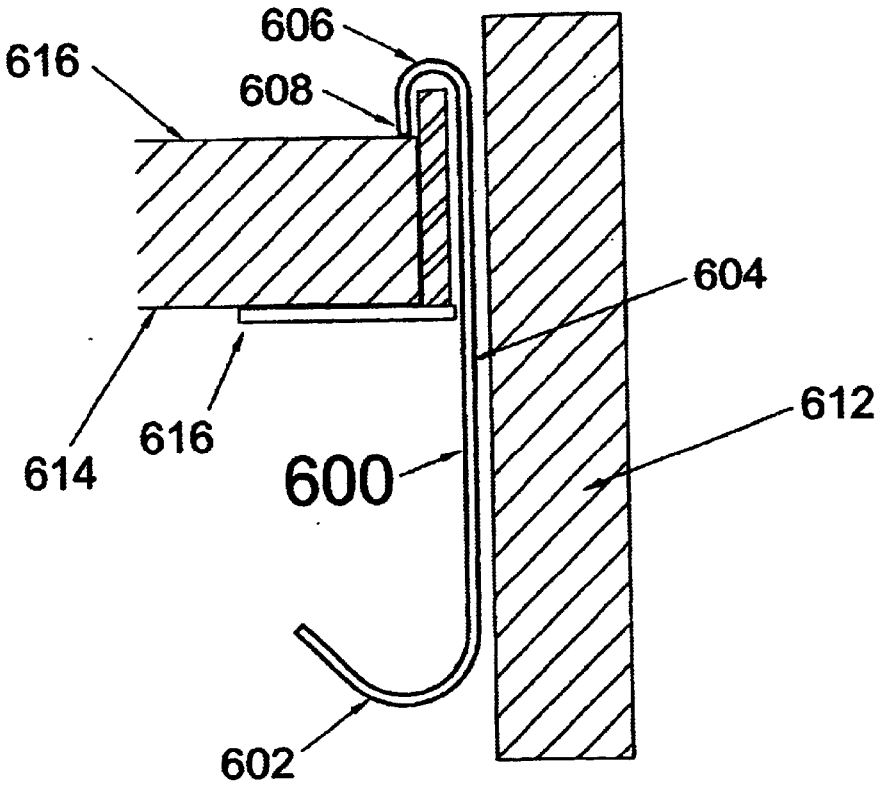
FIG. 12 is a cross-sectional view of a seventh embodiment of the invention in use at the juncture of a ceiling and a wall.

Use of hanger 600 is illustrated in FIG. 12, in which retainer 606 and part of shank 604 are inserted between a wall 612 and a ceiling tile support rail 616. Shank 604 is placed against wall 612 and then hanger 600 is rotated about the axis of shank 604 until retainer 606 lies flat against wall 612. The user then slides hanger 600 upwards, between wall 612 and ceiling tile support rail 616. Hanger 600 is then rotated to bring retainer 606 away from wall 612, and hanger 600 is then pulled slightly downwards, causing retainer 606 to engage ceiling tile support rail 616 and/or a ceiling tile 614. Hanger 600 thus hangs suspended between wall 612 and support rail 616 and/or tile 614. While this embodiment may be formed with suspension hook 602 and retainer 606 lying in a single plane, the benefit of the shape disclosed is added stability and ease of handling during the insertion. When suspension hook 602 is perpendicular to wall 612, plastic sheets are impaled upon hook tip 610 and suspended from suspension hook 602. The weight of the sheets hanging suspended from hanger 600 may also force retainer 606 against a ceiling tile top 618, providing a frictional force and also driving retainer tip 608 into ceiling tile top 618 when ceiling tile 614 is of soft material. The user may also pull downwards on hanger 600 to seat retainer tip 608 into ceiling tile top 618.

Although the illustration is of hanger 600 in use with ceiling tile 614 and support rail 616, this embodiment is also useful in a wide range of situations, e.g., wherever a narrow crack can be utilized to bring retainer 606 above the top of a ceiling, a layer of ceiling tiles, a horizontal panel or other similar ceiling configuration.

This embodiment is subject to numerous changes. In particular, the angle illustrated in FIG. 9, between retainer 606 and suspension hook 602, may be almost any angle greater or less than 45 degrees, or may be omitted altogether and the embodiment confined to a single plane. The configuration and dimensions of hanger 600 and its components may also be altered considerably without departing from the scope of the embodiment. Wire of a wide range of thicknesses may be used, provided that it possesses sufficient strength. While the embodiment disclosed is bent in two planes, the invention may be bent in three or more planes.

Figure 13:
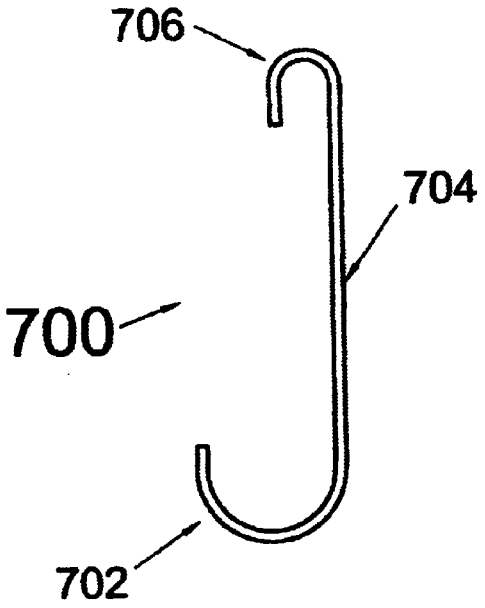
FIG. 13 is a side view of an eighth embodiment of the invention.

FIG. 13 is a side view of an eighth embodiment of the invention. Hanger 700 is comprised of a suspension hook 702, a shank 704 and a retainer 706. The plane of retainer 706 is inclined to the plane of suspension hook 702 by an angle of substantially 60 degrees. Hanger 700 may be used in the same manner as disclosed above in reference to hanger 600, although the two hangers have different dimensions and are not identically configured.

While the invention has been described in detail with respect to specific preferred embodiments thereof, numerous modifications to these specific embodiments will occur to those skilled in the art upon a reading and understanding of the foregoing description; such modifications are embraced within the scope of the appended claims.

What is claimed is:

1. A wire hanger for supporting material therefrom comprising a length of wire configured to define a shank having a suspension hook formed at one end thereof and a retainer formed at the opposite end thereof, the retainer being dimensioned and configured to be mounted to a support structure to engage such support structure having a T- or L-shaped cross section comprised of a vertical leg and a horizontal leg, the wire hanger further comprising an off-set extension extending from the shank, a longitudinal extension extending from the off-set extension, the shank and the longitudinal extension extending in respective opposite directions from the off-set extension, and a retainer hook formed at the end of the longitudinal extension, the retainer hook being dimensioned and configured to fit over such vertical leg, and the retainer hook and the suspension hook extending in opposite directions from the shank.

2. The wire hanger of claim 1 wherein the suspension hook has a sharpened tip.

3. The wire hanger of claim 2 wherein the tip has wedge-like surface.

4. The wire hanger of claim 1 wherein the retainer is dimensioned and configured to engage a support structure selected from the group consisting of a ceiling tile support rail, a pipe, a door top, and a wall.

5. The wire hanger of claim 1 wherein the shank and the longitudinal extension are parallel to each other and perpendicular to the off-set extension.

6. The wire hanger of claim 1 or claim 5 wherein the retainer terminates in a hook which faces the direction opposite the direction in which the suspension hook faces.

7. The wire hanger of claim 4 wherein the wire hanger has an eye through which an attaching member may be placed to secure the wire hanger to such support structure.

8. The wire hanger of claim 1 wherein the retainer comprises a straight piece of wire dimensioned and configured to be driven into such support structure, the straight piece of wire extending from the shank at an angle of about 70 to 110°.

9. The wire hanger of claim 1 wherein the retainer lies in a first plane and the hook lies in a second plane different from the first plane.

10. The wire hanger of claim 9 wherein the angle between the first plane and the second plane is from about 30 to 60 degrees.

11. The wire hanger of claim 1 wherein the wire comprises an annealed spring wire.

12. The wire hanger of claim 1 wherein the retainer hook and the suspension hook have different radii.

13. A wire hanger for supporting material therefrom comprising a length of wire configured to define a shank having a suspension hook formed at one end thereof and a retainer formed at the opposite end thereof, the retainer being dimensioned and configured to be mounted to a support structure, the wire hanger further comprising an off-set extension extending from the shank and a longitudinal extension extending from the off-set extension, the shank and the longitudinal extension extending in respective opposite directions from the off-set extension, and wherein the retainer has a retainer hook formed thereon and the retainer hook and the suspension hook extend in the same direction from the shank.

14. A wire hanger for supporting material therefrom comprising a length of wire configured to define a shank having a suspension hook formed at one end thereof and a retainer formed at the opposite end thereof, the retainer being dimensioned and configured to be mounted to a support structure having a T- or L-shaped cross-section, the wire hanger comprising an off-set extension extending from the shank, a longitudinal extension extending from the off-set extension, the shank and the longitudinal extension extending in respective opposite directions from the off-set extension, and wherein the retainer has a retainer hook formed thereon and the retainer hook and the suspension hook extend in the same direction from the shank.

15. The wire hanger of claim 13 or claim 14 wherein the retainer hook and the suspension hook have different radii.

* * * * *